US006498123B2

(12) United States Patent
Suzuki et al.

(10) Patent No.: US 6,498,123 B2
(45) Date of Patent: Dec. 24, 2002

(54) THERMAL TRANSFER SHEET

(75) Inventors: Taro Suzuki, Tokyo-to (JP); Daisuke Fukui, Tokyo-to (JP); Munenori Ieshige, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 83 days.

(21) Appl. No.: 09/802,677

(22) Filed: Mar. 9, 2001

(65) Prior Publication Data

US 2001/0034302 A1 Oct. 25, 2001

(30) Foreign Application Priority Data

Mar. 24, 2000 (JP) ..... 2000-084138
Nov. 9, 2000 (JP) ..... 2000-341438

(51) Int. Cl.[7] ..... B41M 5/40
(52) U.S. Cl. ..... 503/227; 428/195
(58) Field of Search ..... 428/195, 913, 428/914; 8/471; 503/200, 227

(56) References Cited

FOREIGN PATENT DOCUMENTS

| | | |
|---|---|---|
| JP | 61184717 | 8/1986 |
| JP | 62220385 | 9/1987 |
| JP | 05229271 | 9/1993 |
| JP | 05229272 | 9/1993 |
| JP | 07041932 | 3/1995 |
| JP | 07055630 | 3/1995 |
| JP | 06249558 | 5/1996 |
| JP | 09108613 | 11/1998 |

*Primary Examiner*—Bruce H. Hess
(74) *Attorney, Agent, or Firm*—Ladas & Parry

(57) ABSTRACT

The present invention is to provide a thermal transfer sheet provided with a backface layer having high heat resistance and slipping characteristics by using a one-solution type coating solution adopting an environmentally acceptable general solvent without performing heat treatment such as aging. The thermal transfer sheet provided with the backface layer according to the present invention comprises a transfer ink layer which is melted or sublimated by heating on one surface of a substrate and the backface layer on the other surface of the substrate film, wherein the backface layer comprises a binder which comprises a polyamideimide resin and a polyamideimide silicone resin each having a grass transition temperatures of 200° C. or more based on differential thermal analysis at a specified mixing ratio, a polevalent metal salt of alkyl phosphate and filler at a specified mixing ratio. The thermal transfer sheet prevents the fusion of the film caused by the heat of a thermal head, has high lubricity and stands against high energy, thereby preventing refuses from adhering to the thermal head, enabling high speed printing and also the thermal transfer sheet has high printing stability and running stability.

13 Claims, No Drawings

THERMAL TRANSFER SHEET

BACKGROUND OF THE INVENTION

1. Field of the Invention

The present invention relates to a thermal transfer sheet used in a thermal transfer printer using heating means such as a thermal head, and, more particularly, to a thermal transfer sheet in which a transfer ink layer capable of being melted and sublimated under heat is disposed on one surface of a substrate film and a backface layer is structured of a specific material on the other surface of the substrate film which surface is brought into contact with a thermal head to prevent refuses from adhering to the thermal head so that it has high printing stability and running stability.

2. Description of the Related Art

When a plastic film which is not heat-resistant is used as a substrate of a thermal transfer sheet, this poses the problem that a film sticks to a thermal head and refuses adhere to the thermal head during printing whereby the peeling ability and the slip characteristics are impaired and the substrate film is broken. For this, a method is proposed in which a heat-resistant layer made of a heat-curable resin having high heat resistance is formed. This method improves the heat-resistance but does not serve to improve the slip characteristics. Also, because it is necessary to use a hardener such as a cross-linking agent in this method, the coating solution is a two-solution type resultantly. Further, since the substrate is the plastic thin film which cannot be treated at high temperatures, it is necessary to carry out heat treatment (aging) at relatively low temperatures for a long time over several tense hours after the film is applied to obtain a film which is sufficiently cured. This gives rise to the problem that not only the aging is complicated from the processing point of view but also wrinkles appear during heat treatment and the coating surface is stuck to the backface causing blocking if strict temperature control is not made.

It is proposed to add a lubricant having a relatively low melting point such as silicone oil, low-melting point wax and a surfactant. However, because these lubricants have a low melting point, there are the problems that these lubricants are carried to the backface when the thermal transfer sheet is rolled and the thermal head is contaminated with these lubricants during printing. There are methods of adding a filler to remove these adsorbed materials. However, when an unsuitable material is used, this poses the problem that the coefficient of fiction with the thermal head increases causing wrinkles during printing and the thermal head is worn by the material.

In order to solve these problems, a backface layer made of a silicone polyurethane is proposed in the publication of Japanese Patent Application Laid-Open (JP-A) No. 61-184717 and JP-A No. 62-220385, a heat-resistant protective layer made of a polysiloxane/polyamide type block copolymer is proposed in the publication JP-A No. 5-229271 and a heat resistant protective layer comprising a silicone modified polyimide resin is proposed in the publication of JP-A No. 5-229272. However, each of these resins has low heat resistance and therefore has the drawback that sticking is caused in high energy printing and productivity and environmental adaptability are impaired because a specific solvent is used. Also, a polyamideimide resin composition is proposed in the publication of JP-A No. 8-113647 and the publication of JP-A No. 8-244369 and a heat resistant protective layer made of a polyamideimide resin containing a lubricant is proposed in the publication of JP-A No. 10-297124. All of these materials have insufficient heat resistance, giving rise to the problem that refuses adhere to the head, bringing some influence on the printed image.

SUMMARY OF THE INVENTION

Accordingly, it is an object of the present invention to solve the aforementioned problems of the conventional technologies and to provide a thermal transfer sheet provided with a backface layer having high heat resistance and slip characteristics, the backface layer being formed using a one-solution type coating solution using an environmentally acceptable general solvent without requiring any heat treatment such as aging.

The present invention resides in a thermal transfer sheet provided with a transfer ink layer which is melted or sublimated by heating on one surface of a substrate and a backface layer on the other surface of the substrate film which surface is brought into contact with a thermal head, wherein the backface layer comprises a binder which comprises a polyamideimide resin and a polyamideimide silicone resin each having a grass transition temperatures of 200° C. or more based on differential thermal analysis at a specified mixing ratio, a polevalent metal salt of alkyl phosphate and filler at a specified mixing ratio. If Tg of the aforementioned polyamideimide resin and polyamideimide silicone resin on the basis of differential thermal analysis is less than 200° C., the thermal transfer sheet has inferior heat resistance.

Also, in the present invention, the aforementioned polyamideimide resin and polyamideimide silicone resin are used by mixing the both in a mixing ratio ranging from preferably 1:5 to 5:1 and particularly preferably 1:2 to 2:1. If the ratio of the polyamideimide silicone resin is larger than 1:5, only unsatisfactory heat resistance is obtained, leading to easy production of head refuses. On the other hand, if the ratio of the polyamideimide silicone resin is 5:1 or less, only insufficient lubricity is obtained, causing sticking.

The polyamideimide silicone resin is a copolymer of a polyamideimide resin and a polyfunctional silicone compound having a molecular weight of 1000 to 6000 with a copolymerizing ratio of 0.01 to 0.3 per 1 of the polyamideimide resin by weight. The polyamideimide silicone resin is a modified product of a polyamideimide resin with a polyfunctional silicone compound having a molecular weight of 1000 to 6000 with a modification ratio of 0.01 to 0.3 per 1 of the polyamideimide resin by weight. When the amount of the copolymer or modified product is too small, sufficient lubricity is not obtained in the aforementioned mixing ratio, leading to easy occurrence of sticking. On the other hand when the amount of the copolymer or modified product is too large, the heat resistance and the film strength are decreased.

The polyvalent metal salt of alkyl phosphate is preferably a compound represented by the structural formula 1, wherein R represents an alkyl group having 12 or more carbon atoms, M represents an alkali earth metal, zinc or aluminum and n denotes the valence of M.

[Compound 1]

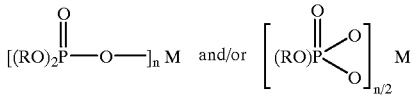

(1)

A polyvalent metal salt of alkylcarboxylic acid is preferably mixed in a specified amount with the polyvalent metal salt of alkyl phosphate.

The mixing ratio of the polyvalent metal salt of alkylcarboxylic acid to the polyvalent metal salt of alkyl phosphate is preferably 1:9 to 9:1.

The polyvalent metal salt of alkylcarboxylic acid is preferably a compound represented by the structural formula 2, wherein R represents an alkyl group having 11 or more carbon atoms, M represents an alkali earth metal, zinc, aluminum or lithium and n denotes the valence of M.

[Compound 2]

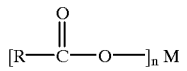

(2)

The proportion of the polyvalent metal salt of alkyl phosphate is preferably 1 to 100 parts by weight and particularly preferably 5 to 20 parts by weight per 100 parts by weight of the binder. If the amount of the polyvalent metal salt of alkyl phosphate to be used is less than the above range, only insufficient releasability can be obtained during thermal printing, so that refuses tend to adhere to a thermal head. On the other hand, if the amount of the polyvalent metal salt of alkyl phosphate exceeds the above range, the physical strength of the backface layer is reduced and therefore such an amount is undesirable.

Also, the filler is preferably a talc.

Further, the talc is preferably mixed in a proportion of 2 to 20 parts by weight per 100 parts by weight of the binder. A proportion in the above range brings about good balance between the lubricity and heat resistance of the backface layer with a good result.

The adhesiveness of the backface layer can be improved by compounding the backface layer further comprises a polyester resin. The proportion of the polyester resin is preferably 0.5 to 10 parts by weight per 100 parts by weight of the binder. When the proportion of the polyester resin is smaller than the above range, the adhesion of the backface layer to the substrate film is inferior, so that the backface is easily peeled whereas the proportion is larger than the above range, the heat resistance is decreased.

DESCRIPTION OF THE PREFERRED EMBODIMENTS

Next, the present invention will be explained by way of embodiments.

(Substrate film)

Any material may be used as the substrate film constituting the thermal transfer sheet of the present invention as far as it is conventionally known and has a certain degree of heat resistance and strength. Examples of these materials are those having a thickness of about 0.5 to 50 $\mu$m and preferably about 3 to 10 $\mu$m and may include a polyethylene terephthalate film, 1,4-polycyclohexylenedimethylene terephthalate film, polyethylene naphthalate film, polyphenylene sulfide film, polystyrene film, polypropylene film, polysulfone film, alamide film, polycarbonate film, polyvinyl alcohol film, cellophane, cellulose derivatives such as cellulose acetate, polyethylene film, polyvinyl chloride film, nylon film, polyimide film and ionomer film and other than the above materials, papers such as condenser paper and paraffin paper, nonwoven fabric or composite materials of a resin and paper or nonwoven fabric.

(Backface layer)

The present invention resides in a thermal transfer sheet provided with a transfer ink layer which is melted or sublimated by heating on one surface of a substrate and a backface layer on the opposite surface of the substrate film which surface is brought into contact with a thermal head, wherein the backface layer comprises a binder which comprises a polyamideimide resin and a polyamideimide silicone resin each having a grass transition temperatures of 200° C. or more based on differential thermal analysis at a specified mixing ratio, a polevalent metal salt of alkyl phosphate and filler at a specified mixing ratio.

In the present invention, the aforementioned polyamideimide resin and polyamideimide silicone resin are used by mixing the both. The mixing ratio is preferably in a range from preferably 1:5 to 5:1 and particularly preferably 1:2 to 2:1. If the ratio of the polyamideimide silicone resin is larger than 1:5, only unsatisfactory heat resistance is obtained, leading to easy production of head refuses. On the other hand, if the ratio of the polyamideimide silicone resin is 5:1 or less, only insufficient lubricity is obtained, causing sticking.

As the polyamideimide resin and the polyamideimide silicone resin to be used, the same materials that are described in the publication of JP-A No. 8-244369 and JP-A No. 8-113647 and, particularly, those having a Tg of 200° C. or more based on differential thermal analysis among these materials are preferably used. With regard to the polyamideimide silicone resin used in the present invention, those in which a compound having a molecular weight of 1000 to 6000 is used as the polyfunctional silicone compound and the amount of the copolymer or modified product is preferably 0.01 to 0.3 per 1 of the polyamideimide resin.

As the polyamideimide resin to be used, those soluble in an alcohol type solvent are preferable. As the polyfunctional silicone compound which serves to copolymerize or modify the polyamideimide resin, a silicone compound having any one of a hydroxyl group, carboxyl group, epoxy group, amino group, acid anhydride group and unsaturated group is preferably used.

If Tg of the aforementioned polyamideimide resin and polyamideimide silicone resin is less than 200° C., the thermal transfer sheet has inferior heat resistance. When the amount of the copolymer or modified product is too small, sufficient lubricity is not obtained in the aforementioned mixing ratio, leading to easy occurrence of sticking whereas when the amount of the copolymer or modified product is too large, the heat resistance and the film strength are decreased.

In the present invention, a polyvalent metal salt of alkyl phosphate is further added to the above resin binder. The polyvalent metal salt of alkyl phosphate is obtained by substituting an alkali metal salt of alkyl phosphate with a polyvalent metal. The polyvalent metal salt of alkyl phosphate is itself known as an additive for plastic and as the polyvalent metal salt of alkyl phosphate, those of various grades are available.

In the present invention, the polyvalent metal salt of alkyl phosphate is preferably a compound represented by the structural formula 1 (R represents an alkyl group having 12 or more carbon atoms, M represents an alkali earth metal, zinc or aluminum and n denotes the valence of M), wherein R is an alkyl group having 12 or more carbon atoms such as a cetyl group, a lauryl group or a stearyl group and, particularly, a stearyl group and M is an alkali earth metal such as barium, calcium or magnesium, zinc or aluminum. n denotes the valence of M.

[Compound 1]

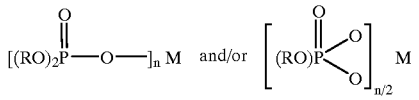

(1)

The proportion of the polyvalent metal salt of alkyl phosphate is preferably 1 to 100 parts by weight and particularly preferably 5 to 20 parts by weight per 100 parts by weight of the binder. If the amount of the polyvalent metal salt of alkyl phosphate to be used is less than the above range, only insufficient releasability can be obtained during thermal printing, so that refuses tend to adhere to a thermal head. On the other hand, if the amount of the polyvalent metal salt of alkyl phosphate exceeds the above range, the physical strength of the backface layer is reduced and therefore such an amount is undesirable.

Also, in the present invention, a thermal releasing agent and a lubricant such as wax, higher fatty acid amides, esters and surfactants may be included when the backface layer is formed from the above materials to the extent that the object of the present invention is impaired. Particularly, it is preferable to mix a polyvalent metal salt of phosphate or alkylcarboxylic acid. Such a polyvalent metal salt is mixed in a mixing ratio ranging from 1:9 to 9:1 and preferably 2:8 to 8:2 based on the polyvalent metal salt of alkyl phosphate. When the amount to be added is excessive, refuses tend to adhere to a thermal head whereas when the amount is excessively small, the addition is becoming of no effect. Further, the polyvalent metal salt of alkylcarboxylic acid to be used is represented by the structural formula 2 (R represents an alkyl group having 11 or more carbon atoms, M represents an alkali earth metal, zinc, aluminum or lithium and n denotes the valence of M), wherein R is an alkyl group having 11 or more carbon atoms, such as a hexadecyl group, dodecyl group and heptadecyl group and particularly, a dodecyl group and heptadecyl group and M is an alkali earth metal such as barium, calcium or magnesium, zinc or aluminum and lithium. n denotes the valence of M.

If the number of carbon atoms is small, availability in industrial applications is difficult, which increases the production cost. Further, the reduction in the entire molecular weight of the product poses the problem that the lubricant is bled from the backface and other places are contaminated therewith. Therefore, such a small number of carbon atoms is therefore undesirable.

As to M, the type of metal may be selected depending on the condition of temperature. The melting point of each of these metals is shown as follows for reference: barium type: 195° C. or more, calcium type: about 140 to 180° C., magnesium type: about 110 to 140° C., zinc type: about 110 to 140° C., aluminum type: about 110 to 170° C. and lithium type: 200° C. or more.

For the present use, a magnesium type, zinc type and aluminum type are particularly preferable.

In the present invention, a filler is added to the backface layer with the intention of improving the heat resistance. Heat resistant particles itself to be used for the filler are known and examples of the heat resistant particles include fine particles such as Hydrotalcite DHT-4A (manufactured by Kyowa Kagaku Kogyo), Talc Microace L-1 and P-3 (manufactured by Nippon Talc), Teflon Rubron L-2 (manufactured by Daikin Industries), Graphite fluoride SCP-10 (manufactured by Sanpo Kagaku Kogyo), Graphite AT40S (manufactured by Oriental Sangyo), or silica calcium carbonate, sedimentous barium sulfate, urea resin crosslinking powder, melamine resin crosslinking powder, wood flour, molybdenum disulfide and boron nitride. Particularly, talc is desirable in view of balance between heat resistance and lubricity.

The amount of the filler to be added is important. When talc is mixed in a proportion of 2 to 20 parts by weight based on 100 parts by weight of the binder, the aforementioned lubricity and heat resistance are good. The amount of the filler is particularly preferably in a range from 5 to 15. If the amount is less than the above range, no improvement in heat resistance is observed and fusion is found in a thermal head. On the other hand, if the amount exceeds the above range, the backface is reduced in lubricity with a thermal head and stripes appears on a print surface when printing is carried out.

This phenomenon is considered to occur from the reason that the backface layer which is made physically fragile is rubbed by a thermal head and peeled.

In the present invention, a polyester resin may be further compounded in the backface to improve adhesion to the substrate film. When the polyester resin is used, a preferable amount of the polyester resin to be compounded is 0.5 to 10 parts by weight per 100 parts by weight of the binder. If the amount is less than the above range, the adhesion of the backface to the substrate film is insufficient, causing peeling. If the amount is larger than the above range, the heat resistance is decreased. Therefore, the amount out of the above range is undesirable. Particularly preferable range is from 1 to 10 parts by weight.

The backface is formed by dissolving and dispersing materials as mentioned above in a toluene/ethanol (1/1) solvent to prepare a coating solution and by applying this coating solution by a conventional coating method using, for example, a gravure coater, roll coater or wire bar, followed by drying. The coating amount, specifically, the coating amount of the backface is important. In the present invention, a backface layer having a sufficient performance can be formed in a thickness corresponding to a coating amount of 0.7 g/m2 or less and preferably 0.1 to 0.6 g/m2 on a dry solid basis.

If the thickness of the backface layer is too large, sensitivity during printing is decreased and such a thickness is therefore undesirable.

(Transfer ink layer)

As the transfer ink layer to be formed on the other surface of the above substrate film, a layer containing a sublimation dye, specifically, a thermal sublimation dye layer is formed in the case of a sublimation type thermal transfer sheet whereas a thermally meltable ink layer which is colored using a pigment or the like is formed in the case of a thermally meltable type thermal transfer sheet.

The case of the sublimation type thermal transfer sheet will be hereinafter explained as a typical example; however the present invention is not limited only to the sublimation type thermal transfer sheet. As a dye to be used in the sublimation type transfer ink layer, any one of dyes which are conventionally used in known thermal transfer sheets may be used in the present invention without any particular limitation. Given as several preferable examples of the dye are MS RED G, Macro Red Violet R, Ceres Red 7B, Samaron Red HBSL and Resolin Red F3BS as red dyes, Phorone Brilliant Yellow 6GL, PTY-52 and Macrolex Yellow 6G as yellow dyes and Kayaset Blue 714, Waxorin Blue AP-FW and Phorone Brilliant Blue -S-R and MS Blue 100 as blue dyes.

Preferable examples of the binder resin for carrying a dye as mentioned above include cellulose type resins such as ethyl cellulose, hydroxyethyl cellulose, ethylhydroxy cellulose, hydroxypropyl cellulose, methyl cellulose, cellulose acetate and cellulose acetate butyrate, vinyl type resins such as polyvinyl alcohol, polyvinyl acetate, polyvinylbutyral, polyvinylacetoacetal and polyvinylpyrrolidone, acrylic resins such as poly(meth) acrylate and poly(meth)acrylamide, polyurethane type resins, polyamide type resins and polyester type resins. Among these compounds, cellulose type, vinyl type, acryl type, urethane type and polyester type resins are desirable in view of heat resistance and the mobility of the dye.

The dye layer may be formed by applying a solution or dispersion, in which the aforementioned dye and binder to which additives such as releasing agents and inorganic fine particles are added according to the need are either dissolved in an appropriate organic solvent such as toluene, methyl ethyl ketone, ethanol, isopropyl alcohol, cyclohexanone or DMF or dispersed in an organic solvent or water, on one surface of the aforementioned substrate film by means of a gravure printing method, screen printing method or reverse roll coating printing method using a gravure plate, followed by drying. The dye layer formed in this manner has a thickness of about 0.2 to 5.0 $\mu$m and preferably about 0.4 to 2.0 $\mu$m. Also, it is appropriate that the amount of the sublimation dye present in the dye layer is 5 to 90 weight % and preferably 10 to 70 weight % of the dye layer. When the dye layer is formed, one color is selected from the aforementioned dyes in the case where an intended image is monochrome and suitable cyan, magenta and yellow (further black as required) dyes are selected to form yellow, magenta and cyan (further black as required) dye layers in the case where an intended image is a full-color image.

An image sheet which is a transfer-receiving material and uses the thermal transfer sheet as aforementioned is used to form an image and may be any image receiving sheet as far as its record surface has dye-receiving capability enough to receive the above dyes. In the case of paper, metal, glass or synthetic resin which has no dye-receiving capability, a dye-receiving layer may be formed on at least one surface of such a material. Also, in the case of a thermally meltable type thermal transfer sheet, no particular limitation is imposed on the transfer-receiving sheet and general paper and plastic films may be used. As a printer used when thermal transfer is performed using the aforementioned thermal transfer sheet and image-receiving sheet, a known thermal transfer printer can be used as it is and no particular limitation is imposed on the printer.

EXAMPLES

The present invention will be hereinafter explained in more detail by way of examples, which, however, are not intended to be limiting of the invention.

In the descriptions hereinbelow, all designations of parts and % are on a weight basis, unless otherwise noted.

Example

Polyamideimide resin (HR-15ET, manufactured by Toyobo)
Polyamideimidesilicone resin (HR-14ET, manufactured by Toyobo)
Zinc stearyl phosphate (LBT1830, manufactured by Sakai Chemical Industry)
Talc (Microace P-3, manufactured by Nippon Talc)
Polyester resin (Byron 220, manufactured by Toyobo)

The above materials were adjusted using an ethanol/toluene (1/1) solvent such that a solid content was 10%. Each materials were mixed as shown in Tables 1 and 2. After each of the mixtures was stirred, dispersion treatment was performed using a paint shaker for 3 hours to obtain inks for a backface layer. Each of these inks was applied to one surface of a polyester film (thickness: 6 $\mu$m, Lumilar F53, manufactured by Toray) by using a wire bar coater in a coating amount specified on a dry weight basis and then subjected to drying treatment performed in an oven at 80° C. for one minute to form a backface layer.

Backface layer inks having the mix ratios shown in Tables 1 and 2 were manufactured. Thus, Examples 1 to 5, Examples 6 to 10, Examples 14 to 17, Examples 18 to 21, Examples 22 to 26 and Comparative Examples 1 to 9 were prepared.

TABLE 1

| Change in the ratio of the binder | Coating amount (g/m$^2$) | Polyamideimide resin HR15ET | Polyamideimide silicone resin HR14ET | Polyvalent metal salt of alkyl phosphate LBT1830 | Filler, Microace P-3 | Polyester resin, Byron 220 | Other lubricants |
|---|---|---|---|---|---|---|---|
| Comparative Example 1 | 0.4 | 0 | 100 | 10 | 10 | 2 | |
| Example 1 | 0.4 | 16.7 | 83.3 | 10 | 10 | 2 | |
| Example 2 | 0.4 | 33.3 | 66.7 | 10 | 10 | 2 | |
| Example 3 | 0.4 | 50 | 50 | 10 | 10 | 2 | |
| Example 4 | 0.4 | 66.7 | 33.3 | 10 | 10 | 2 | |
| Example 5 | 0.4 | 83.3 | 16.7 | 10 | 10 | 2 | |
| Comparative Example 2 | 0.4 | 100 | 0 | 10 | 10 | 2 | |
| Change in the amount of the polyvalent metal salt of alkyl phosphate | | | | | | | |
| Comparative Example 3 | 0.4 | 50 | 50 | 0 | 10 | 2 | |
| Example 6 | 0.4 | 50 | 50 | 5 | 10 | 2 | |
| Example 7 (Example 3) | 0.4 | 50 | 50 | 10 | 10 | 2 | |
| Example 8 | 0.4 | 50 | 50 | 20 | 10 | 2 | |
| Example 9 | 0.4 | 50 | 50 | 50 | 10 | 2 | |
| Example 10 | 0.4 | 50 | 50 | 100 | 10 | 2 | |
| Addition of other lubricants | | | | | | | Prisurf A-208S |
| Example 11 | 0.4 | 50 | 50 | 10 | 10 | 2 | 5 |
| Example 12 | 0.4 | 50 | 50 | 10 | 10 | 2 | 10 |

TABLE 1-continued

| Change in the ratio of the binder | Coating amount ($g/m^2$) | Polyamideimide resin HR15ET | Polyamideimide silicone resin HR14ET | Polyvalent metal salt of alkyl phosphate LBT1830 | Filler, Microace P-3 | Polyester resin, Byron 220 | Other lubricants |
|---|---|---|---|---|---|---|---|
| | | | | | | | Zinc stearate GF200 |
| Example 12.1 | 0.4 | 50 | 50 | 1 | 10 | 2 | 9 |
| Example 12.2 | 0.4 | 50 | 50 | 3 | 10 | 2 | 7 |
| Example 12.3 | 0.4 | 50 | 50 | 5 | 10 | 2 | 5 |
| Example 12.4 | 0.4 | 50 | 50 | 7 | 10 | 2 | 3 |
| Example 12.5 | 0.4 | 50 | 50 | 9 | 10 | 2 | 1 |
| Example 12.6 | 0.4 | 50 | 50 | 10 | 10 | 2 | 10 |
| Example 12.7 | 0.4 | 50 | 50 | 15 | 10 | 2 | 15 |
| | | | | | | | Zinc laurate GP |
| Example 12.8 | 0.4 | 50 | 50 | 5 | 10 | 2 | 5 |
| Example 12.9 | 0.4 | 50 | 50 | 10 | 10 | 2 | 10 |
| | | | | | | | Aluminum stearate 1600 |
| Example 12.9a | 0.4 | 50 | 50 | 5 | 10 | 2 | 5 |
| | | | | | | | Aluminum laurate |
| Example 12.9b | 0.4 | 50 | 50 | 5 | 10 | 2 | 5 |
| | | | | | | | Magnesium stearate GF200 |
| Example 12.9c | 0.4 | 50 | 50 | 5 | 10 | 2 | 5 |
| | | | | | | | Calucium stearate GF200 |
| Example 12.9d | 0.4 | 50 | 50 | 5 | 10 | 2 | 5 |
| | | | | | | | S7000 |
| Example 12.9e | 0.4 | 50 | 50 | 5 | 10 | 2 | 5 |

TABLE 2

| Change in the type of polyvalent metal salt of alkyl phosphate | Coating amount ($g/m^2$) | Polyamideimide resin HR15ET | Polyamideimide silicone resin HR14ET | Polyvalent metal salt of alkyl phosphate LBT1830 | Filler, Microace P-3 | Polyester Polyester resin, Byron 220 | Other lubricants |
|---|---|---|---|---|---|---|---|
| Example 13 | 0.4 | 50 | 50 | 10 | 10 | 2 | |
| Change in the amount of the filler | | | | | | | |
| Comparative Example 4 | 0.4 | 50 | 50 | 10 | 0 | 2 | |
| Example 14 | 0.4 | 50 | 50 | 10 | 5 | 2 | |
| Example 15 (Example 3) | 0.4 | 50 | 50 | 10 | 10 | 2 | |
| Example 16 | 0.4 | 50 | 50 | 10 | 15 | 2 | |
| Example 17 | 0.4 | 50 | 50 | 10 | 20 | 2 | |
| Comparative Example 5 | 0.4 | 50 | 50 | 10 | 30 | 2 | |
| Change in the amount of the polyester resin | | | | | | | |
| Comparative Example 5 | 0.4 | 50 | 50 | 10 | 10 | 0 | |
| Example 18 | 0.4 | 50 | 50 | 10 | 10 | 1 | |
| Example 19 (Example 3) | 0.4 | 50 | 50 | 10 | 10 | 2 | |
| Example 20 | 0.4 | 50 | 50 | 10 | 10 | 5 | |
| Example 21 | 0.4 | 50 | 50 | 10 | 10 | 10 | |
| Comparative Example 7 | 0.4 | 50 | 50 | 10 | 10 | 20 | |
| Change in the coating amount of the backface layer | | | | | | | |
| Comparative Example 8 | 0.05 | 50 | 50 | 10 | 10 | 2 | |
| Example 22 | 0.1 | 50 | 50 | 10 | 10 | 2 | |
| Example 23 | 0.2 | 50 | 50 | 10 | 10 | 2 | |
| Example 24 (Example 3) | 0.4 | 50 | 50 | 10 | 10 | 2 | |
| Example 25 | 0.6 | 50 | 50 | 10 | 10 | 2 | |
| Example 26 | 0.7 | 50 | 50 | 10 | 10 | 2 | |
| Comparative Example 9 | 1.0 | 50 | 50 | 10 | 10 | 2 | |

As a material variation within the scope of the present invention, a sheet of Example 13 was prepared by forming a backface layer in the same manner as in the above method except that, among the above materials, zinc stearyl phosphate was altered to aluminum stearyl phosphate (LBT1813, manufactured by Sakai Chemical Industry).

As examples in which other lubricants are further added to the above materials, sheets of Examples 11 and 12 were prepared by forming a backface layer in the same manner as above by using a material to which 5 parts or 10 parts of a phosphate type surfactant (Prisurf A-208S, manufactured by Dai-Ichi Kogyo Seiyaku) which was adjusted such that the solid content was 10%.

Zinc carboxylate (Zinc stearate GF-200, manufactured by Nippon Oil and Fats) having a heptadecyl group was adjusted such that the solid content was 10% to produce a backface layer ink having the percentage composition shown in Table 1 thereby producing Examples 12. 1 to 12. 7.

Zinc carboxylate (Zinc laurate GP, manufactured by Nippon Oil and Fats) having a dodecyl group was adjusted such that the solid content was 10% to produce a backface layer ink having the percentage composition shown in Table 1 thereby producing Examples 12.8 to 12.9.

Aluminum carboxylate (Aluminum stearate #600, manufactured by Nippon Oil and Fats) having a heptadecyl group was adjusted such that the solid content was 10% to produce a backface layer ink having the percentage composition shown in Table 1 thereby producing Example 12.9a.

Aluminum carboxylate (Aluminum laurate) having a dodecyl group was adjusted such that the solid content was 10% to produce a backface layer ink having the percentage composition shown in Table 1 thereby producing Example 12.9b.

Magnesium carboxylate (Magnesium stearate GF200, manufactured by Nippon Oil and Fats) having a heptadecyl group was adjusted such that the solid content was 10% to produce a backface layer ink having the percentage composition shown in Table 1 thereby producing Example 12.9c.

Calcium carboxylate (Calcium stearate GF200, manufactured by Nippon Oil and Fats) having a heptadecyl group was adjusted such that the solid content was 10% to produce a backface layer ink having the percentage composition shown in Table 1 thereby producing Example 12.9d.

Lithium carboxylate (S-7000, manufactured by Sakai Chemical Industry) having a heptadecyl group was adjusted such that the solid content was 10% to produce a backface layer ink having the percentage composition shown in Table 1 thereby producing Example 12.9e.

These examples were evaluated for a print image to obtain the results as shown in Tables 3 and 4.

A backface layer was formed on one surface of a substrate film in the same manner as above in Examples 1 to 26 (including Examples 12.1 to 12.9, Examples 12.9a to 12.9e) and Comparative Examples 1 to 9 and a dye layer was formed as a transfer ink layer on the other surface of the substrate film in all examples. The dye layer was formed in accordance with the condition of the dye layer of the transfer sheet used for a Sublimation printer CP770 manufactured by Mitsubishi Electric Corporation. In the following evaluation, an image-receiving sheet (standard type) for the Sublimation Printer CP770 manufactured by Mitsubishi Electric Corporation was used as the transfer-receiving sheet.

TABLE 3

| | Thermal fusion characteristics | Coefficient of dynamic friction | Separation of the backface layer | Print sensitivity |
|---|---|---|---|---|
| Change in the ratio of the binder | | | | |
| Comparative Example 1 | X | ○ | ○ | ○ |
| Example 1 | Δ | ○ | ○ | ○ |
| Example 2 | ○ | ○ | ○ | ○ |
| Example 3 | ○ | ○ | ○ | ○ |
| Example 4 | ○ | ○–Δ | ○ | ○ |
| Example 5 | ○ | Δ | ○ | ○ |
| Comparative Example 2 | — | X | — | — |
| Change in the mount of the polyvalent metal salt of alkyl phosphate | | | | |
| Comparative Example 3 | X | ○ | ○ | ○ |
| Example 6 | ○ | ○ | ○ | ○ |
| Example 7 (Example 3) | ○ | ○ | ○ | ○ |
| Example 8 | ○ | ○ | ○ | ○ |
| Example 9 | Δ | Δ | Δ | ○ |
| Example 10 | Δ–X | Δ | Δ | ○ |
| Addition of other lubricants | | | | |
| Example 11 | ○ | ○ | ○ | ○ |
| Example 12 | ○ | ○ | ○ | ○ |
| Addition of other lubricants | | | | |
| Example 12.1 | Δ | ○ | ○ | ○ |
| Example 12.2 | Δ | ○ | ○ | ○ |
| Example 12.3 | ○ | ○ | ○ | ○ |
| Example 12.4 | ○ | ○ | ○ | ○ |
| Example 12.5 | ○ | ○ | ○ | ○ |
| Example 12.6 | ○ | ○ | ○ | ○ |
| Example 12.7 | ○ | ○ | ○ | ○ |

TABLE 3-continued

| | Thermal fusion characteristics | Coefficient of dynamic friction | Separation of the backface layer | Print sensitivity |
|---|---|---|---|---|
| Addition of other lubricants | | | | |
| Example 12.8 | ○ | ○ | ○ | ○ |
| Example 12.9 | ○ | ○ | ○ | ○ |
| Example 12.9a | Δ | Δ | ○ | ○ |
| Example 12.9b | ○ | ○ | ○ | ○ |
| Example 12.9c | ○ | ○ | ○ | ○ |
| Example 12.9d | Δ | ○ | ○ | ○ |
| Example 12.9e | Δ | ○ | ○ | ○ |

TABLE 4

| | Thermal fusion characteristics | Coefficient of dynamic friction | Separation of the backface layer | Print sensitivity |
|---|---|---|---|---|
| Change in the type of polyvalent metal salt of alkyl phosphate | | | | |
| Example 13 | ○ | ○ | ○ | ○ |
| Change in the amount of the filler | | | | |
| Comparative Example 4 | X | ○ | ○ | ○ |
| Example 14 | ○–Δ | ○ | ○ | ○ |
| Example 15 (Example 3) | ○ | ○ | ○ | ○ |
| Example 16 | ○ | ○–Δ | ○–Δ | ○ |
| Example 17 | ○ | Δ | Δ | ○ |
| Comparative Example 5 | ○ | X | X | ○–Δ |
| Change in the amount of the polyester resin | | | | |
| Comparative Example 6 | Δ | ○ | X | ○ |
| Example 18 | ○ | ○ | ○ | ○ |
| Example 19 (Example 3) | ○ | ○ | ○ | ○ |
| Example 20 | ○ | ○ | ○ | ○ |
| Example 21 | ○ | ○ | ○ | ○ |
| Comparative Example 7 | X | X | ○ | ○ |
| Change in the coating amount of the backface layer | | | | |
| Comparative Example 8 | X | ○–Δ | X | ○ |
| Example 22 | Δ | ○–Δ | ○–Δ | ○ |
| Example 23 | ○ | ○–Δ | ○ | ○ |
| Example 24 (Example 3) | ○ | ○ | ○ | ○ |
| Example 25 | ○ | ○ | ○ | ○ |
| Example 26 | ○ | ○ | ○ | Δ |
| Comparative Example 9 | ○–Δ | ○ | ○ | Δ |

The evaluation in these examples was made according to the following method and criteria.

(Thermal fusion characteristics)

Using a thermal head KST-105-13FAN manufactured by Kyocera Corporation, a 50% slanting line pattern 100 m in length was printed under a load of 4 KgW at a print energy of 0.11 W/dot to observe the amount of the material stuck to a heating element of the thermal head by using a microscope.

The criteria for the evaluation was as follows: the case where the thickness of the stuck material was 5000 angstroms or more was "x", and the case where the thickness of the stuck material was from 5000 to 3000 angstroms was "Δ" and the case where the thickness of the stuck material was 3000 angstroms or less was "○".

(Coefficient of dynamic friction)

Using a thermal head KST-105-13FAN manufactured by Kyocera Corporation, a load of 4 KgW was applied to it to measure a coefficient of dynamic friction between the thermal head and the backface layer.

The criteria for the evaluation was as follows: the case where the coefficient of dynamic friction was 0.35 or more was "x", the case where coefficient of dynamic friction was from 0.35 to 0.30 was "Δ" and the case where the coefficient of dynamic friction was 0.30 or less was "○".

(Separation of the backface layer)

A solid image was printed using a Sublimation Printer CP770 manufactured by Mitsubishi Electric Corporation to observe stripes which appeared on the print surface.

The criteria for the evaluation was as follows: the case where the number of stripes was 10 or more was "x", the case where the number of stripes was from 10 to 3 was "Δ" and the case where the number of stripes was 3 or less was "○".

(Print sensitivity)

A density step pattern was printed using a Sublimation Printer CP770 manufactured by Mitsubishi Electric Corporation to measure the print density by using a reflection densitometer Macbeth RD918.

The criteria for the evaluation was as follows: the case where a reduction in density in a step in which the reflection density was 1.0 was greater than that of a conventional product by 0.20 or more was "x", the case where the reduction was greater than that of a conventional product by 0.10 to 0.20 was "Δ" and the case where the reduction was greater than that of a conventional product by 0.10 or less was "○".

As is explained above, the backface layer according to the present invention enables the application of a general solvent in a one-solution state. The thermal transfer sheet provided with the backface layer according to the present invention comprises a transfer ink layer which is melted or sublimated by heating on one surface of a substrate and the backface layer on the other surface of the substrate film, wherein the backface layer comprises a binder which comprises a polyamideimide resign and a polyamideimide silicone resin each having a grass transition temperatures of 200° C. or more based on differential thermal analysis at a specified mixing ratio, a polevalent metal salt of alkyl phosphate and filler at a specified mixing ratio. Therefore, the thermal transfer sheet prevents the fusion of the film caused by the heat of a thermal head, has high lubricity and stands against high energy, thereby preventing refuses from adhering to the thermal head, enabling high speed printing and also the thermal transfer sheet has high printing stability and running stability.

What is claimed is:

1. A thermal transfer sheet provided with a transfer ink layer which is melted or sublimated by heating on one surface of a substrate and a backface layer on the other surface of the substrate film which surface is brought into contact with a thermal head, wherein the backface layer comprises a binder which comprises a polyamideimide resin and a polyamideimide silicone resin each having a grass transition temperatures of 200° C. or more based on differential thermal analysis at a specified mixing ratio, a polevalent metal salt of alkyl phosphate and filler at a specified mixing ratio.

2. A thermal transfer sheet according to claim 1, wherein the mixing ratio of said polyamideimide resin and polyamideimide silicone resin is 1:5 to 5:1.

3. A thermal transfer sheet according to claim 1, wherein said polyamideimide silicone resin is a copolymer of a polyamideimide resin and a polyfunctional silicone compound having a molecular weight of 1000 to 6000 with a copolymerizing ratio of 0.01 to 0.3 per 1 of the polyamideimide resin by weight.

4. A thermal transfer sheet according to claim 1, wherein said polyamideimide silicone resin is a modified product of a polyamideimide resin with a polyfunctional silicone compound having a molecular weight of 1000 to 6000 with a modification ratio of 0.01 to 0.3 per 1 of the polyamideimide resin by weight.

5. A thermal transfer sheet according to claim 1, wherein said polyvalent metal salt of alkyl phosphate is a compound represented by the structural formula 1:

[Compound 1]

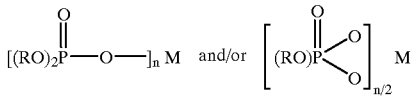

(1)

wherein R represents an alkyl group having 12 or more carbon atoms, M represents an alkali earth metal, zinc or aluminum and n denotes the valence of M.

6. A thermal transfer sheet according to claim 1, wherein a polyvalent metal salt of alkylcarboxylic acid is mixed in a specified amount with said polyvalent metal salt of alkyl phosphate.

7. A thermal transfer sheet according to claim 6, wherein the mixing ratio of the polyvalent metal salt of alkylcarboxylic acid to the polyvalent metal salt of alkyl phosphate is preferably 1:9 to 9:1.

8. A thermal transfer sheet according to claim 6, wherein said polyvalent metal salt of alkylcarboxylic acid is a compound represented by the structural formula 2:

[Compound 2]

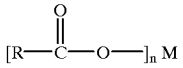

(2)

wherein R represents an alkyl group having 11 or more carbon atoms, M represents an alkali earth metal, zinc, aluminum or lithium and n denotes the valence of M.

9. A thermal transfer sheet according to claim 1, wherein the proportion of said polyvalent metal salt of alkyl phosphate is 1 to 100 parts by weight per 100 parts by weight of the binder.

10. A thermal transfer sheet according to claim 1, wherein said filler is a talc.

11. A thermal transfer sheet according to claim 10, wherein said talc is mixed in a proportion of 2 to 20 parts by weight per 100 parts by weight of the binder.

12. A thermal transfer sheet according to claim 1, wherein said backface layer further comprises a polyester resin.

13. A thermal transfer sheet according to claim 12, wherein the proportion of said polyester resin is 0.5 to 10 parts by weight per 100 parts by weight of the binder.

* * * * *